US006938550B2

(12) United States Patent
Frisch

(10) Patent No.: US 6,938,550 B2
(45) Date of Patent: Sep. 6, 2005

(54) SYSTEM AND METHOD FOR PRINT SCREEN TONAL CONTROL AND COMPENSATION

(75) Inventor: James N. Frisch, Mundelein, IL (US)

(73) Assignee: R. R. Donnelley & Sons, Co., Downers Grove, IL (US)

( * ) Notice: Subject to any disclaimer, the term of this patent is extended or adjusted under 35 U.S.C. 154(b) by 0 days.

(21) Appl. No.: 10/697,219

(22) Filed: Oct. 30, 2003

(65) Prior Publication Data

US 2004/0129161 A1 Jul. 8, 2004

Related U.S. Application Data

(60) Provisional application No. 60/422,767, filed on Oct. 31, 2002.

(51) Int. Cl.[7] ..... B41F 1/54; B41M 1/14; G06K 15/00

(52) U.S. Cl. ..... 101/484; 101/211; 358/1.13

(58) Field of Search ..... 101/114–129, 483–493, 101/365, 211; 358/1.9, 504, 1.13

(56) References Cited

U.S. PATENT DOCUMENTS 3,567,923 A * 3/1971 Hutchison ..... 101/484
3,748,046 A 7/1973 Murray ..... 356/425
3,835,777 A 9/1974 Krygeris ..... 101/350.4
4,233,663 A 11/1980 Sugawara et al. ..... 358/296
4,553,835 A 11/1985 Morgan, Jr. ..... 355/77
4,629,428 A 12/1986 Phillips ..... 434/98
4,677,298 A 6/1987 Zelmanovic et al. .... 250/341.8
4,852,485 A 8/1989 Brunner ..... 101/211
4,971,446 A 11/1990 Kurata ..... 356/402
5,031,534 A 7/1991 Brunner ..... 101/365
5,122,977 A * 6/1992 Pfeiffer ..... 101/211
5,206,707 A 4/1993 Ott ..... 356/402
5,357,448 A 10/1994 Stanford ..... 382/112

(Continued)

*Primary Examiner*—Daniel J. Colilla
*Assistant Examiner*—Wasseem H. Hamdan
(74) *Attorney, Agent, or Firm*—Hanley, Flight & Zimmerman, LLC

(57) ABSTRACT

A print screen tonal control and compensation system and method are provided in which a compensated density curve is utilized to increase press predictability, performance, resources consumption, color variation, and quality. A computerized test pattern is generated, and by applying computer to plate technology, a printed press produces a printed test pattern. The test pattern is subsequently analyzed to identify the plugging point of the production run, and a compensated density curve is created to eliminate plugging within the production pattern. The density curve is then used to generate a compensated printing plate for use in a production press run.

20 Claims, 5 Drawing Sheets

U.S. PATENT DOCUMENTS 5,365,847 A 11/1994 Pers ..... 101/248
5,499,305 A 3/1996 Lidke et al. ..... 382/270
5,500,744 A 3/1996 Sabath ..... 358/3.07
5,528,377 A 6/1996 Hutcheson ..... 358/1.9
5,537,516 A 7/1996 Sherman et al. ..... 358/1.9
5,548,407 A 8/1996 von Kienlin et al. ..... 358/1.9
5,636,330 A 6/1997 Barak ..... 358/1.9
5,677,967 A * 10/1997 Pariser ..... 382/167
5,689,624 A 11/1997 Allegrezza ..... 358/1.13
5,734,800 A * 3/1998 Herbert et al. ..... 358/1.9
5,748,330 A 5/1998 Wang et al. ..... 358/3.21
5,748,336 A 5/1998 Kakutani ..... 382/252
5,781,206 A * 7/1998 Edge ..... 347/19
5,791,249 A 8/1998 Quadracci ..... 101/450.1
5,812,903 A 9/1998 Yamada et al. ..... 399/42
5,841,897 A 11/1998 Numakura et al. ..... 382/163
5,841,955 A 11/1998 Wang ..... 358/1.9
5,887,221 A 3/1999 Grace ..... 399/49
5,903,712 A 5/1999 Wang et al. ..... 358/1.9
5,947,029 A * 9/1999 Loeffler et al. ..... 101/484
5,957,049 A * 9/1999 Ammeter et al. ..... 101/211
5,967,049 A 10/1999 Seymour et al. ..... 101/484
5,967,050 A * 10/1999 Seymour ..... 101/484
5,992,318 A * 11/1999 DiBello et al. ..... 101/181
6,011,878 A 1/2000 Ushida et al. ..... 382/298
6,022,403 A * 2/2000 Kuo ..... 106/31.86
6,025,922 A 2/2000 Marsden ..... 358/1.1
6,027,201 A * 2/2000 Edge ..... 347/19
6,028,674 A 2/2000 Tognazzini ..... 358/1.13
6,033,137 A 3/2000 Ito ..... 400/74
6,097,503 A 8/2000 Felleman ..... 358/1.9
6,115,561 A 9/2000 Fukushima ..... 399/49
6,148,158 A 11/2000 Amemiya ..... 399/39
6,175,427 B1 1/2001 Lehmbeck et al. ..... 358/1.1
6,201,936 B1 3/2001 Gross et al. ..... 399/49
6,215,562 B1 * 4/2001 Michel et al. ..... 358/1.9
6,450,097 B1 * 9/2002 Kistler et al. ..... 101/483
6,469,804 B1 * 10/2002 Ott et al. ..... 358/1.9
6,532,082 B1 * 3/2003 Dewitte ..... 358/3.3
6,564,714 B2 * 5/2003 Brydges et al. ..... 101/484
6,604,466 B2 * 8/2003 Komori et al. ..... 101/484
6,698,355 B2 * 3/2004 Fukui ..... 101/485
6,725,772 B2 * 4/2004 Martinez et al. ..... 101/211
2002/0178952 A1 * 12/2002 Sainio et al. ..... 101/485
2003/0058462 A1 * 3/2003 Martinez et al. ..... 358/1.9

* cited by examiner

A
116
INK PLUGGING PRIOR TO 100% ?
YES
NO
126
CREATE DENSITY CURVE FOR EACH SCREEN GREATER THAN +1% ABOVE MAXIMUM DENSITY
120
ANY OTHER PRESS CONSIDERATIONS ?
YES
124
APPLY OTHER PRESS CONSIDERATIONS
NO
128
APPLY DENSITY CURVE TO PRINTING PLATES FOR PRESS AND PAPER
122
RUN TEST PATTERN ON PRESS
130
IS INK PLUGGING ?
YES
132
ADJUST DENSITY CURVE
NO
134
MAINTAIN SAME PRESS PARAMETERS
END

SYSTEM AND METHOD FOR PRINT SCREEN TONAL CONTROL AND COMPENSATION

CROSS REFERENCE TO RELATED APPLICATION

This application is a non-provisional application claiming priority from U.S. Provisional Application Ser. No. 60/422,767, titled "System and Method for Print Screen Tonal Control and Compensation" and filed Oct. 31, 2002.

TECHNICAL FIELD

The disclosed system and method is generally related to computer to plate imaging and more specifically to a system and method for increasing the predictability of press performance, through the use of a predictive press monitoring system.

BACKGROUND

Printing press screening and computer to plate technology is generally well known in the art. Print screens typically offer a graduated scale which may be generated in incremental steps, for example in one percent (1%) increments from zero percent (0%) to one hundred percent (100%). While patterns generated on a computer screen typically produce accurate depictions of the screening due to the accuracy of a computer monitor, upon the production of the pattern on a printing press, a printed pattern often displays saturation of ink above a certain screen value. The area above the screened value, regardless of color, which print as solid (even though it is screened) is referred to as the point in which the printing process "plugs."

The plugging of a production printing press leads to many undesirable effects, including the waste of material resources, and importantly, the apparent lack of quality in the production press run. Thus, many printing press operators desire a system, whereby a quality press product is produced while utilizing the minimal amount of resources.

BRIEF DESCRIPTION OF THE DRAWINGS

Certain features and advantages in the system and method disclosed herein will become apparent to those skilled in the art upon reading the following description in conjunction with the drawing figures, in which.

DETAILED DESCRIPTION

Although the following text sets forth a detailed description of numerous different embodiments, it should be understood that the legal scope of the invention is defined by the claims herein below. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention. In addition, unless any filed claim element is defined by reciting the word "means" and a function without the recital of any structure, it is not intended that the scope of any claim element be interpreted based on the application of 35 U.S.C. § 112, sixth paragraph.

Figure 1:
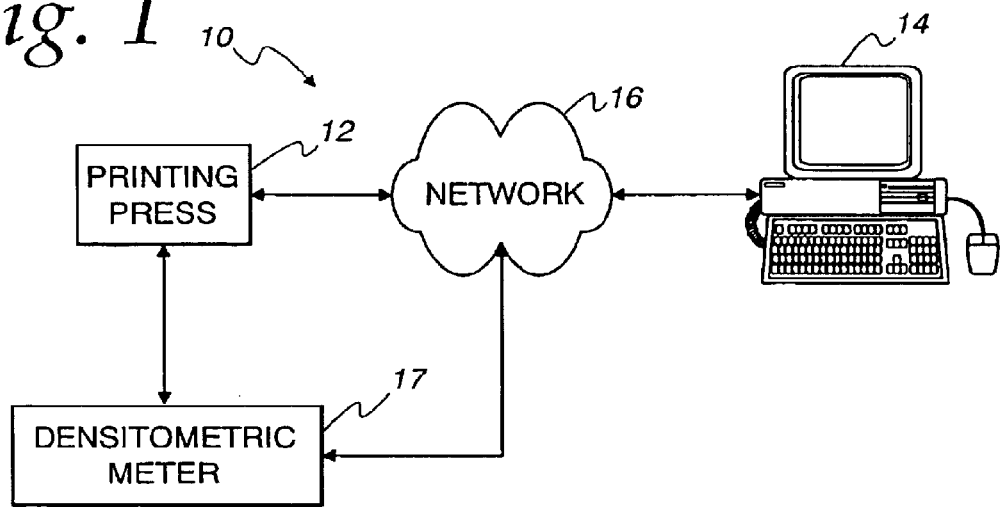
FIG. 1 is a block diagram of an embodiment of a print screen tonal control system in accordance with the invention.

FIG. 1 illustrates one embodiment of a data network 10. The data network 10 may include a printing press 12 operatively coupled to a network computer 14 via a network 16. The data network 10 may also include a densitometric meter 17 operatively coupled to a network computer 14 via a network 16. The printing press 12 may be, by way of example rather than limitation, an offset press printing process as is known in the art. The densitometric meter 17 may be, for example a photospectrometer, densitomer and/or the like. The network 16 may be provided using a variety of techniques well known to those skilled in the art for the transfer of electronic data. For example, the network 16 may comprise dedicated access lines, telephone lines, satellite links, and/or any other means of communication or combination. Additionally, the network 16 may include a plurality of network computers or server computers (not shown), each of which may be operatively interconnected in a known manner. Where the network 16 comprises the Internet, data communication may take place over the network 16 via an Internet communication protocol or any other protocol.

The network computer 14 may be a computer of the type commonly employed in networking solutions. The network computer 14 may be used to accumulate, analyze, and download data relating to the operation of the printing press 12 and more particularly to the performance of any production printing plate. For example, the network computer 14 may periodically receive data from the printing press 12 indicative of the status of the press. This information may be accumulated and periodically analyzed to monitor the performance of the press.

Although the data network 10 is shown to include one network computer 14, and one printing press 12, it should be understood that different numbers of computers and presses may be utilized. For example, the network 16 may include a plurality of network computers 14, and a plurality of printing presses 12, all of which may be interconnected via the network 16. According to the disclosed example, this configuration may provide several advantages, such as, for example, enabling near real time uploads and downloads of information as well as periodic uploads and downloads of information. This provides for a primary backup of all the valuable printing press operational information.

Figure 2:
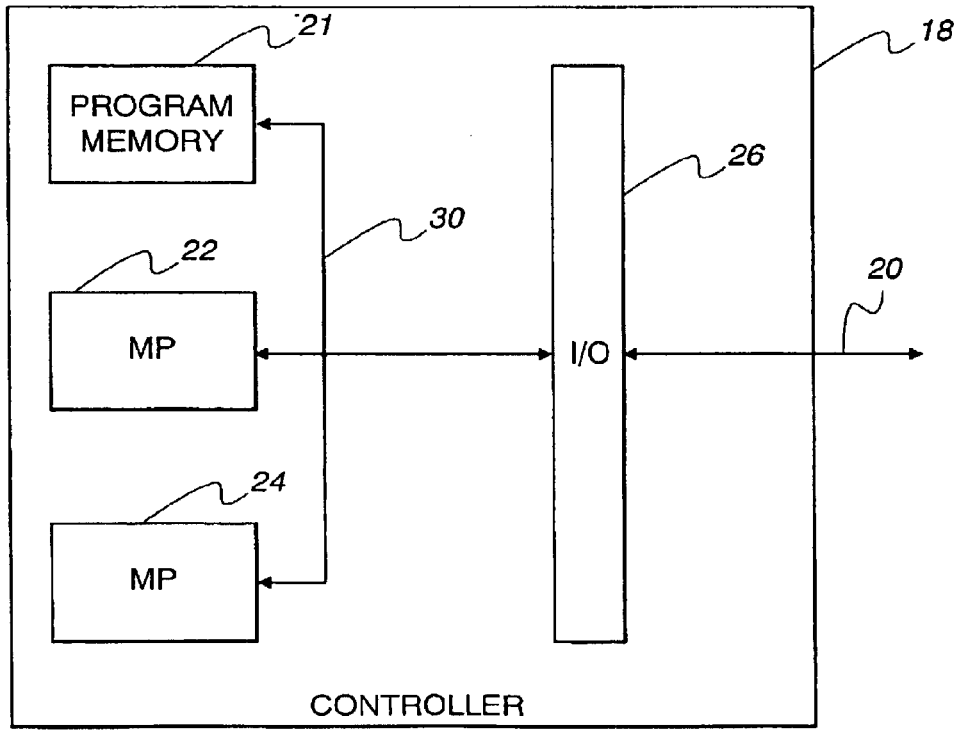
FIG. 2 is a block diagram of the electronic components of the print screen tonal control system of FIG. 1.

FIG. 2 is a schematic diagram of one possible embodiment of the network computer 14 shown in FIG. 1. The network computer 14 may have a controller 18 that is operatively connected to the network 16 via link 20. While not shown, components may also be linked to the controller 18 as required in a known manner.

The controller 18 may include a program memory 21, a microcontroller or a microprocessor (MP) 22, a randomaccess memory (RAM) 24, and an input/output (I/O) circuit 26, all of which may be interconnected via an address/data bus 30. It should be appreciated that although only one microprocessor 22 is shown, the controller 18 may include multiple microprocessors 22. Similarly, the memory of the controller 18 may include multiple RAMs 24 and multiple program memories 21. The RAM(s) 24 and programs memories 21 may be implemented as semiconductor memories, magnetically readable memories, and/or optically readable memories, for example. In addition, although the I/O circuit 26 is shown as a single block, it should be appreciated that the I/O circuit 26 may include a number of different types of I/O circuits.

Although the program memory 21 is shown in FIG. 2 as a read-only memory (ROM), the program memory of the controller 18 may be a read/write or alterable memory, such as a hard disk. In the event a hard disk is used as a program memory, the address/data bus 30 may comprise multiple address/data buses, which may be of different types, and there may be an I/O circuit disposed between the address/data buses.

Figure 3:
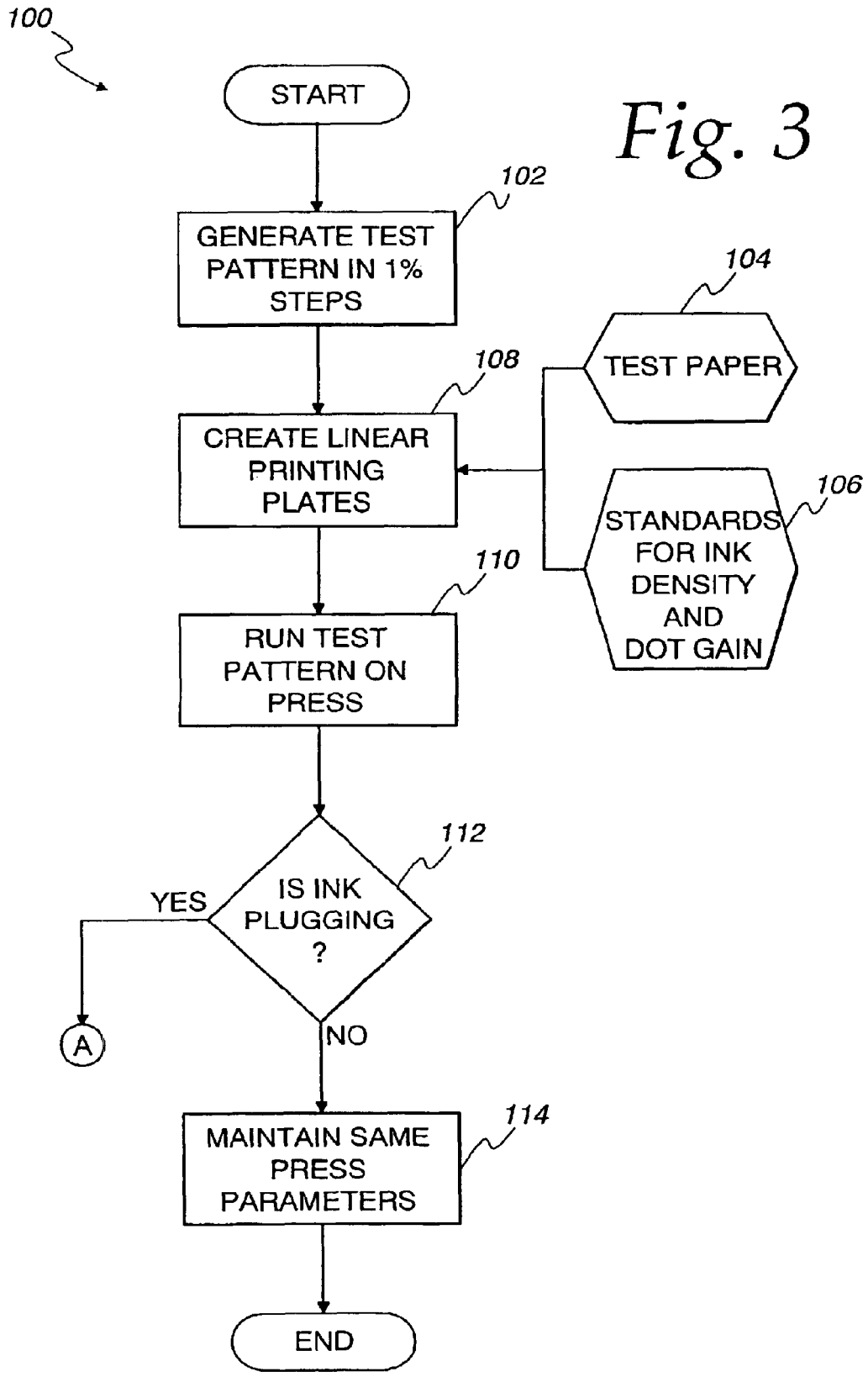
FIGS. 3 and 4, when joined along the similarly lettered lines, together comprise a generalized flowchart of programming executed by a print screen tonal control and compensation system.
Figure 4:
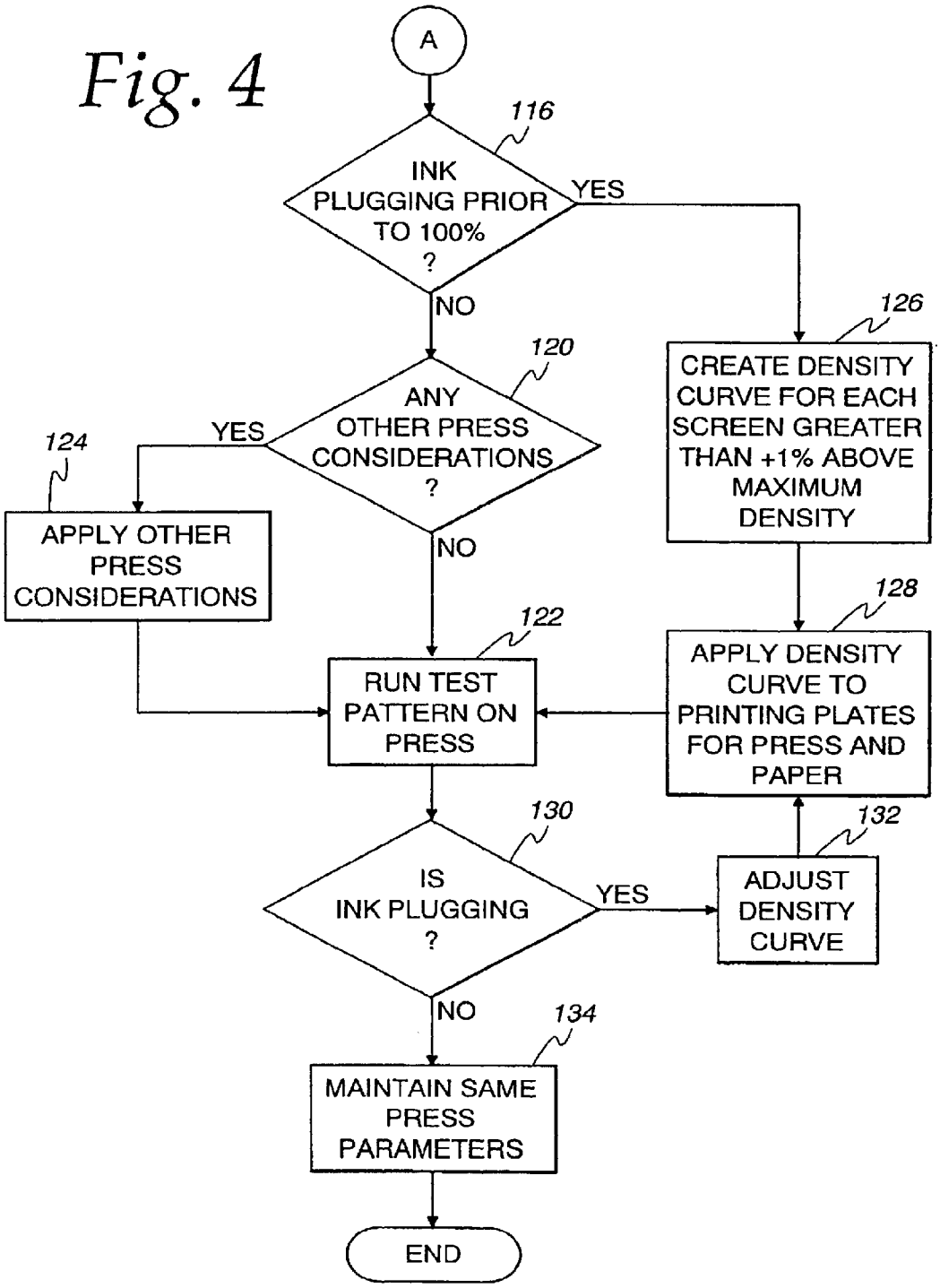
Figure 5:
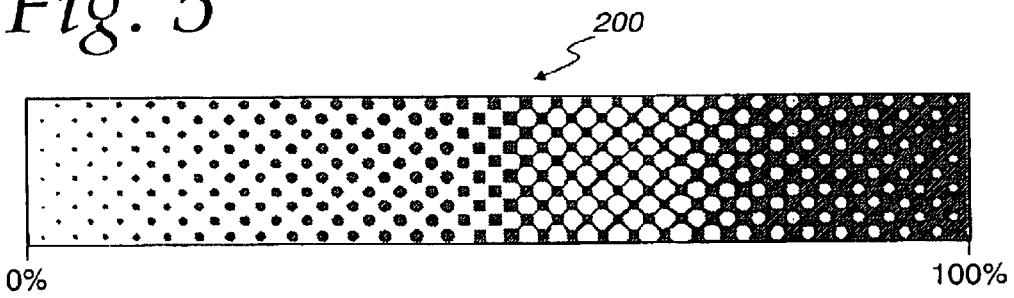
FIG. 5 is a computer generated test pattern with a full range of screening (0%–100%)

FIGS. 3 and 4, when joined along the similarly lettered lines, together illustrate a flowchart of a main operating routine 100 that may be stored in the program memory 21 of the controller 18. Referring to FIG. 3, the main routine 100 may begin operation at block 102 during which a test pattern 200 (see FIG. 5) may be generated in incremental steps, according to any known test pattern generation techniques. The incremental steps may be, by way of example rather than limitation, in one percent (1%) steps from zero percent (0%) to one hundred percent (100%). The test pattern 200 shown in FIG. 5 exemplifies a full range of screening (0% to 100%) wherein the screen decreases in open (white) area until it becomes solid ink (black). Once the desired test pattern 200 is generated, the routine 100, at a block 108, combines the pattern 200 with data parameters for a test paper 104 and standards for the press ink and desired dot gain 106 to create a linear printing plate according to known printing plate creation methods, for example, by using known computer to plate imaging technology.

Once the printing plate is created, a press run is initiated on the printing press 12 at a block 110. At a block 112, the routine 100 determines whether the ink has reached a maximum density, or the "plugging point." In other words, the press run is examined using a densitometric meter (photospectrometer or densitomer) to determine the peak ink film thickness as determined by the density reading wherein the thickness reading achieves the value determined as reading "solid" (100% tonal value). If the routine 100 determines that the plugging point has not been reached, the routine 100 maintains the current press parameters at the block 114 and ends the test press run. If, however, the routine 100 determines that the plugging point has indeed been reached, at a block 116 (see FIG. 4), the routine 100 analyzes the test pattern to establish whether the plugging point has occurred before the maximum screening point, or in this example, the 100% point.

Upon determination that the plugging point has not occurred before the maximum screening point, a block 120 determines whether there are any other press considerations that need to be applied in order to complete a production printing run. For example, other press considerations would extend to press operations outside normal parameters such as ink emulsification, excessive water, ink densities above upper control limits of industry standards, all of which would distort the response of screened images on paper. Any of these conditions would cause instability and excessive dot gain which potentially would invalidate the process. If there are no other press considerations to be applied, the routine 100 may run the pattern again at a block 122. If, however, the block 120 determines that there are other press considerations, the necessary adjustment parameters are applied to the printing press 12 at a block 124 before the block 122 runs the pattern again.

Figure 6:
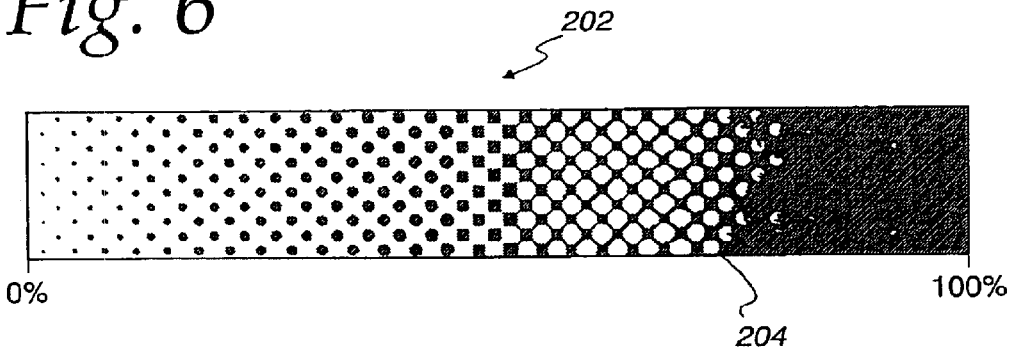
FIG. 6 is a sample result of a press run utilizing an uncompensated printing plate developed in accordance with the test pattern of FIG. 5.

Alternatively, if the plugging point has occurred before the maximum screening point, a block 126 creates a density curve for each screen increment greater than the maximum density. Referring to FIG. 6, there is illustrated a sample test printing 202, wherein a plugging point 204 is illustrated at approximately the eighty percent (80%) screen, before the maximum screening point of one hundred percent (100%).

Figure 8:
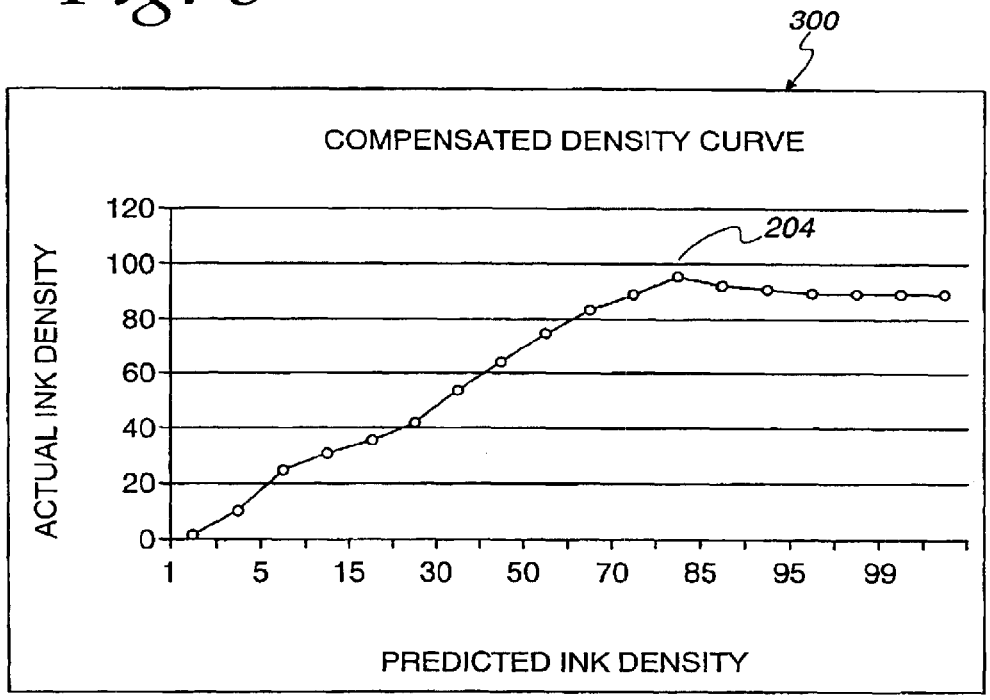
FIG. 8 is a graph plotting a sample black ink density compensated in response to the sample result of the press run of FIG. 6.

Now referring to FIG. 8, there is illustrated a sample compensated density curve 300 created from the test printing 202, wherein the density curve 300 may be applied at every one percent (1%) increment greater than the plugging point 204. As is shown, the routine 100 identifies the location of the plugging point 204, e.g., approximately the eighty percent (80%) density mark, and for every one percent (1%) screen increment greater than the plugging point 204 the routine 100 maintains a screen value sufficiently reduced to cause the ink to transfer to the paper without plugging. The density curve 300 may apply a linear screen ruling to reduce the amount of ink present in the process and to enhance the water balance for control of the tonal range. The density curve 300 may then be translated to a printing plate utilizing known computer to plate technology at a block 128 and the routine 100 may run the pattern again at the block 122.

Figure 7:
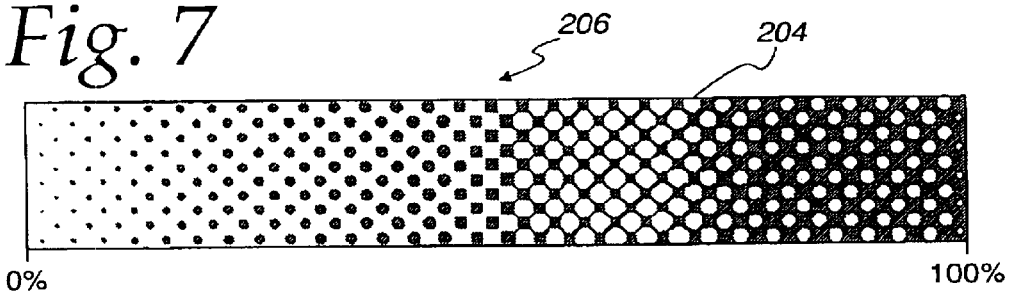
FIG. 7 is a sample result of a press run utilizing the test pattern of FIG. 5 in combination with the print screen tonal control and compensation system of FIG. 1.

Illustrated in FIG. 7, is a sample production run of a screen pattern 206 produced in accordance with the density curve 300. As is shown, the pattern 206 displays little or no plugging of ink at or beyond the previously identified plugging point 204.

Once the screen pattern 206 is produced, to perform quality control and to insure that the printing press 12 is in fact not producing any plugging, the routine 100 may monitor the pattern 206 at a block 130, according to procedures described hereinabove. If the block 130 determines that the pattern 206 is producing discernable plugging, the density curve 300 may be adjusted at a block 132 to compensate the screen values. The corrected density curve may then be applied to a printing plate, as before, at the block 128, and the press run may be repeated at the block 122.

Once the block 130 determines that the screen pattern 206 is not producing any discernable plugging, the press parameters are determined to be acceptable, and they are maintained for production printing at a block 134. The press parameters therefore provide a level of control over the image density, the press ink transfer, and the reduction of over-inking of solid areas, thereby reducing production costs and increasing production quality.

Although certain embodiments have been disclosed and described, the scope of coverage of this patent is not limited thereto. On the contrary, this patent covers all embodiments of the teachings of the invention fairly falling within the scope of any claim to the disclosed subject matter, either literally or under the doctrine of equivalents.

What is claimed is:

1. A method for print screen tonal control compensation on a printing press, the method comprising:

providing a test screening pattern having a plurality of predetermined screening densities including a maximum screening density;

printing the test screening pattern in ink;

measuring an ink density of at least a portion of the printed test screening pattern using a densitometric meter;

determining the measured ink density of the printed test screening pattern at which the test screening pattern reaches a plugging point representing a solid screening; and adjusting each of the ink densities of the printed test screening pattern above the plugging point, by a screening value sufficiently reduced to cause the printing press to print a screening pattern without reaching the plugging point prior to the maximum screening density of the screening pattern.

2. The method of claim 1, wherein the maximum screening density represents a solid screening.

3. The method of claim 1, wherein the printing press prints for a particular paper and a particular ink type and wherein providing a test screening pattern further comprises selecting the test screening pattern in dependence upon at least one of the particular paper and the particular ink.

4. The method of claim 1, wherein providing a test screening pattern further comprises generating the test screening pattern on a computer.

5. The method of claim 1, wherein the compensation is undertaken a number of times.

6. The method of claim 5, wherein the compensation is undertaken until the measured ink density at which the plugging point is reached is not less than the maximum screening density of the test screening pattern.

7. The method of claim 1, wherein the densitometric meter is one of a photospectrometer, densitometer, or combination thereof.

8. A method of calibrating a printing press, the method comprising:

generating a test screening pattern having a plurality of predetermined screening densities including a maximum density;

creating a printing plate to cause the printing press to print the generated test screening pattern;

printing the generated test screening pattern on the printing press;

measuring an ink density of at least a portion of the printed test screening pattern using a densitometric meter;

determining the measured ink density of the printed test screening pattern at which the printed test screening pattern reaches a plugging point representative of a solid screening;

creating a density curve for each of the screening densities of the printed test screening pattern above the determined ink density that reaches the plugging point, wherein the density curve represents a screening value sufficiently reduced to cause the printing press to print the test screening pattern without reaching the plugging point; and creating a production printing plate to cause the printing press to print the generated test screening pattern in combination with the density curve.

9. The method of claim 8, wherein generating a test screening pattern further comprises generating a test pattern having a plurality of screening densities including a maximum screening density representing a solid screening.

10. The method of claim 8, wherein the printing press prints for a particular paper and a particular ink type and wherein generating the test screening pattern further comprises generating the test screening pattern in dependence upon at least one of the particular paper and the particular ink.

11. The method of claim 8, wherein generating the test screening pattern further comprises generating the test screening pattern on a computer.

12. The method of claim 8, wherein the calibration is undertaken a number of times.

13. The method of claim 12, wherein the calibration is undertaken until the printed test screening pattern does not reach the plugging point.

14. A method of calibrating a printing press, the method comprising:

(a) generating a test screening pattern having a plurality of predetermined screening densities including a maximum density representing a solid screening;

(b) creating a printing plate to cause the printing press to print the generated test screening pattern;

(c) printing the generated test screening pattern on the printing press;

(d) measuring an ink density of at least a portion of the printed test screening pattern using a densitometric meter;

(e) determining the measured density of the printed test screening pattern at which the printed test screening pattern reaches a plugging point representative of a solid screening;

(f) creating a density curve for each of the screening densities of the printed test screening pattern above the determined density at which the printed test screening pattern reaches the plugging point, wherein the density curve represents a screening value sufficiently reduced to cause the printing press to print the test screening pattern without reaching the plugging point prior to the maximum density;

(g) adjusting the printing press in accordance with the density curve; and (h) repeating steps (b) through (g) if the determined density at which the printed test screening pattern reaches the plugging point is greater than the maximum density.

15. The method of claim 14, wherein the printing press prints for a particular paper and a particular ink type and wherein step (a) further comprises generating the test screening pattern in dependence upon at least one of the particular paper and the particular ink.

16. The method of claim 14, wherein step (a) further comprises generating the test screening pattern on a computer.

17. A print screen tonal control and compensation system comprising:

a printing press adapted to print a screening pattern;

a densitometric meter adapted to determine an ink density of at least a portion of the screening pattern; and a controller operatively coupled to the printing press and the densitometric meter, the controller comprising a processor and a memory operatively coupled to the processor, the controller being programmed to generate a test screening pattern having a plurality of screening densities including a maximum screening density representing a solid screening, the controller being programmed to cause the test screening pattern to be printed by the printing press, the controller being programmed to cause the densitometric meter to determine a maximum ink density of the printed test screening pattern, the controller being programmed to determine whether the maximum ink density of the printed test screening is a solid screening, the controller being programmed compare the determined maximum ink density of the printed test screening with the maximum screening density representing a solid screening to determine a plugging point indication, the controller being programmed to create a density curve for each screening density not less than the plugging point indication, and the controller being programmed to apply the density curve to the test screening pattern.

18. The system of claim 17, wherein the printing press prints for a particular paper and a particular ink type and wherein the controller being programmed to generate the test screening pattern in dependence upon at least one of the particular paper and the particular ink.

19. The system of claim 17, wherein the densitometric meter is one of a photospectrometer, densitometer, or combination thereof.

20. The system of claim 17, wherein the printing press is an offset printing press.

* * * * *